US007478731B1

(12) United States Patent
Mason

(10) Patent No.: US 7,478,731 B1
(45) Date of Patent: Jan. 20, 2009

(54) PRODUCT DISPLAY PARTITION AND BIASING DEVICE

(75) Inventor: Timothy L. Mason, Melville, NY (US)

(73) Assignee: New Dimensions Research Corporation, Melville, NY (US)

( * ) Notice: Subject to any disclaimer, the term of this patent is extended or adjusted under 35 U.S.C. 154(b) by 397 days.

(21) Appl. No.: 11/329,021

(22) Filed: Jan. 10, 2006

(51) Int. Cl.
*A47F 1/04* (2006.01)

(52) U.S. Cl. ..... 211/59.3

(58) Field of Classification Search ..... 211/59.3, 211/184, 189, 175; 312/61, 71
See application file for complete search history.

(56) References Cited

U.S. PATENT DOCUMENTS 2,658,628 A * 11/1953 Hilgen ..... 211/184
4,183,438 A * 1/1980 Huczek ..... 211/59.2
4,503,982 A * 3/1985 Lewis ..... 211/184
4,792,051 A * 12/1988 Miller ..... 211/184
4,905,847 A * 3/1990 Hanson ..... 211/184
5,464,105 A * 11/1995 Mandeltort ..... 211/184
5,605,237 A * 2/1997 Richardson et al. ..... 211/59.3
6,041,720 A * 3/2000 Hardy ..... 108/60
6,082,557 A * 7/2000 Leahy ..... 211/59.3
6,290,077 B2 * 9/2001 Sosso ..... 211/189
6,357,606 B1 * 3/2002 Henry ..... 211/59.3
6,886,699 B2 * 5/2005 Johnson et al. ..... 211/59.3
7,086,541 B2 * 8/2006 Robertson ..... 211/59.3
2005/0072747 A1 * 4/2005 Roslof et al. ..... 211/59.3
2007/0068885 A1 * 3/2007 Busto et al. ..... 211/59.3
2007/0256992 A1 * 11/2007 Olson ..... 211/59.3

* cited by examiner

*Primary Examiner*—Jennifer E. Novosad
(74) *Attorney, Agent, or Firm*—Collard & Roe, P.C.

(57) ABSTRACT

An assembly for securing to a shelf having products disposed thereon and connection points spaced apart by a fixed distance includes an adjustable product display partition and a biasing device for biasing a row of products toward a front of the shelf. The product display partition includes a number of openings for selectively securing it to the shelf. The product display portion may be reversible with walls of differing heights to accommodate products of various heights. The biasing device includes a product advancing member slidably mounted to a base portion with a support for holding at least one product against its face. A biasing element biases the product advancing member toward a first end of the base. A product held against the face pushes against a product not held against said face to bias a row of products toward the front of the shelf.

14 Claims, 4 Drawing Sheets

PRODUCT DISPLAY PARTITION AND BIASING DEVICE

BACKGROUND OF THE INVENTION

1. Field of the Invention

The invention relates to devices for displaying products which are disposed on a shelf. More particularly, the invention relates to product display partitions and biasing devices for securing to a shelf having a plurality of connection points thereon.

2. The Prior Art

It is known in the retail industry to secure partitions to shelves for separating a row of products arranged on the shelf from an adjacent row of similar or dissimilar products. The shelves typically include a plurality of connection points arranged in a regular pattern with a fixed distance, for example one inch, between adjacent connection points. The plurality of connection points allows retailers to secure one or more partitions to the shelf at appropriate locations to accommodate particular products to be displayed.

The positioning of such partitions on the shelf is dictated by the spacing of the connection points provided on the shelf unit. For example, if the shelf connection points are spaced at one inch on center, it has heretofore been possible to adjust the location of a partition on the shelf only in one inch increments.

Existing systems fail to make efficient use of the available shelf space. For example, if the size of a product is such that it requires only an additional ¼ inch of width between partitions, the partition would need to be moved a full inch to the next shelf connection point, resulting in a loss of ¾ inches of shelf space.

Accordingly, there exists the need for a partition which can be adjusted in increments of less than the spacing between shelf connection points in order to provide more efficient use of shelf space and to allow a spacing between partitions to be more closely tailored to a product's width.

It is also known to provide partitions having a front wall portion. However, the appropriate height of a front partition wall depends on the dimensions of the product to be displayed, particularly the height of the product. When products of varying heights are to be displayed adjacent such partitions, a number of different partitions are needed, each having a front wall sized to accommodate the particular product dimensions. Accordingly, the need exists for a reversible partition having walls of different heights, wherein the partition can be positioned on a shelf with a wall having a height appropriate to the product to be displayed positioned adjacent to a front of the shelf.

It is further known to use a biasing device to bias a row of products displayed on a shelf toward a front portion of the shelf. Such devices push a row of remaining products forward toward a front of the shelf as a product is removed, thereby maintaining a neat, fully stocked appearance and eliminating the need for manual leveling of shelves. Known biasing devices use an element of fixed size to push against a rearmost product in a row. However, depending on the dimensions of the product, various sized pushing elements are required. Thus a biasing device with a larger sized pushing element is needed for larger products, and a pushing device having a smaller sized pushing element is needed for smaller products. Accordingly, the need exists for a biasing device which can be used for products of various sizes.

SUMMARY OF THE INVENTION

In one embodiment of the invention, a product display partition for selectively securing to a shelf having a plurality of connection points spaced apart by a fixed distance includes a base portion. The base portion has a first end and a second end. A dividing wall extends upwardly from the base portion and spans between the first and second ends, dividing the base portion into a first side and a second side.

A plurality of openings for securing the product display partition to the shelf are provided. The plurality of openings include a first pair of openings which includes a first opening disposed at the first end and first side of the base portion and a second opening disposed at the second end and second side of the base portion. The plurality of openings further includes a second pair of openings which includes a third opening disposed at the first end and first side of the base portion and a fourth opening disposed at the second end and second side of the base portion.

A center of the first opening and a center of the second opening are spaced apart in a direction substantially perpendicular to the dividing wall by a first distance equal to the distance between the connection points on the shelf. A center of the third opening and a center of the fourth opening are also spaced apart in a direction substantially perpendicular to the dividing wall by this distance. The center of the first opening the center of the third opening are spaced apart in the direction substantially perpendicular to the dividing wall by a second distance less than the distance between the connection points on the shelf.

The product display partition is securable to the shelf connection points at intervals equal to the second distance by aligning the first and second openings or the third opening and fourth openings with the shelf connection points.

In another embodiment of the invention, a reversible product display partition for selectively securing to a shelf having a plurality of connection points spaced apart by a fixed distance includes a base portion. The base portion has a first end and a second end and at least one opening disposed at the first end and at least one opening disposed at the second end for securing the reversible product display partition to the shelf connection points.

A first wall extends upwardly from the first end of the base portion and has a first height. A second wall extends upwardly from the second end of the base portion and has a second height. The height of the first wall is smaller than the height of the second wall. A dividing wall extends upwardly from the base portion and spans between the first wall and the second wall.

The reversible product display partition is selectively securable to the shelf with either the first wall or the second wall adjacent to a front of the shelf in order to accommodate products of various heights.

A further embodiment of the invention includes a device for biasing a row of products toward a front portion of a shelf on which the products are disposed, wherein the shelf has a plurality of connection points spaced apart by a fixed distance. The biasing device includes a base portion with a first end adjacent to the front portion of the shelf and a second end adjacent to the rear portion of the shelf. At least one opening is disposed at the first end and at least one opening is disposed at the second end for securing the base portion to the shelf.

A product advancing member is slidably mounted to the base portion. The product advancing member includes a face extending substantially perpendicular to the base portion and a support for holding at least one product against the face.

A biasing element biases the product advancing member toward the first end of the base portion. The product held against the face pushes against a product not held against the face and disposed immediately in front of the product held against the face, thereby biasing the row of products toward the front portion of a the shelf.

In another embodiment of the invention, an assembly for securing to a shelf having a plurality of products disposed thereon and having a plurality of connection points spaced apart by a fixed distance includes at least one product display partition disposed adjacent to a biasing device, another product display partition, and/or a reversible product display partition.

One advantage of a product display partition according to an embodiment of the invention is that a position of the partition can be adjusted in increments less than the spacing between shelf connection points in order to provide more efficient use of shelf space and to allow a spacing between partitions to be more closely tailored to a product's width. This result is accomplished according to an embodiment of the invention by providing a partition having a plurality of openings at each end thereof, wherein the openings are arranged so as to allow the partition to be secured to a shelf at intervals less than a spacing between shelf connection points.

A further advantage of a product display partition according to an embodiment of the invention is that the partition may include walls of different heights disposed at either end of the partition. Such a partition is reversible so that it can be positioned on a shelf with either a taller or a shorter wall adjacent to a front of the shelf in order to accommodate products of various heights.

An advantage of a biasing device according to an embodiment of the invention is that the biasing device can be used for products of various sizes, as one or more products held against a face of a product advancing member of the biasing device are used to push against the other products to bias a row of products toward a front of the shelf. Since the product itself is used to push against other products, the biasing device is suitable for use with a wide variety of product sizes.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE DRAWINGS

Figure 1:
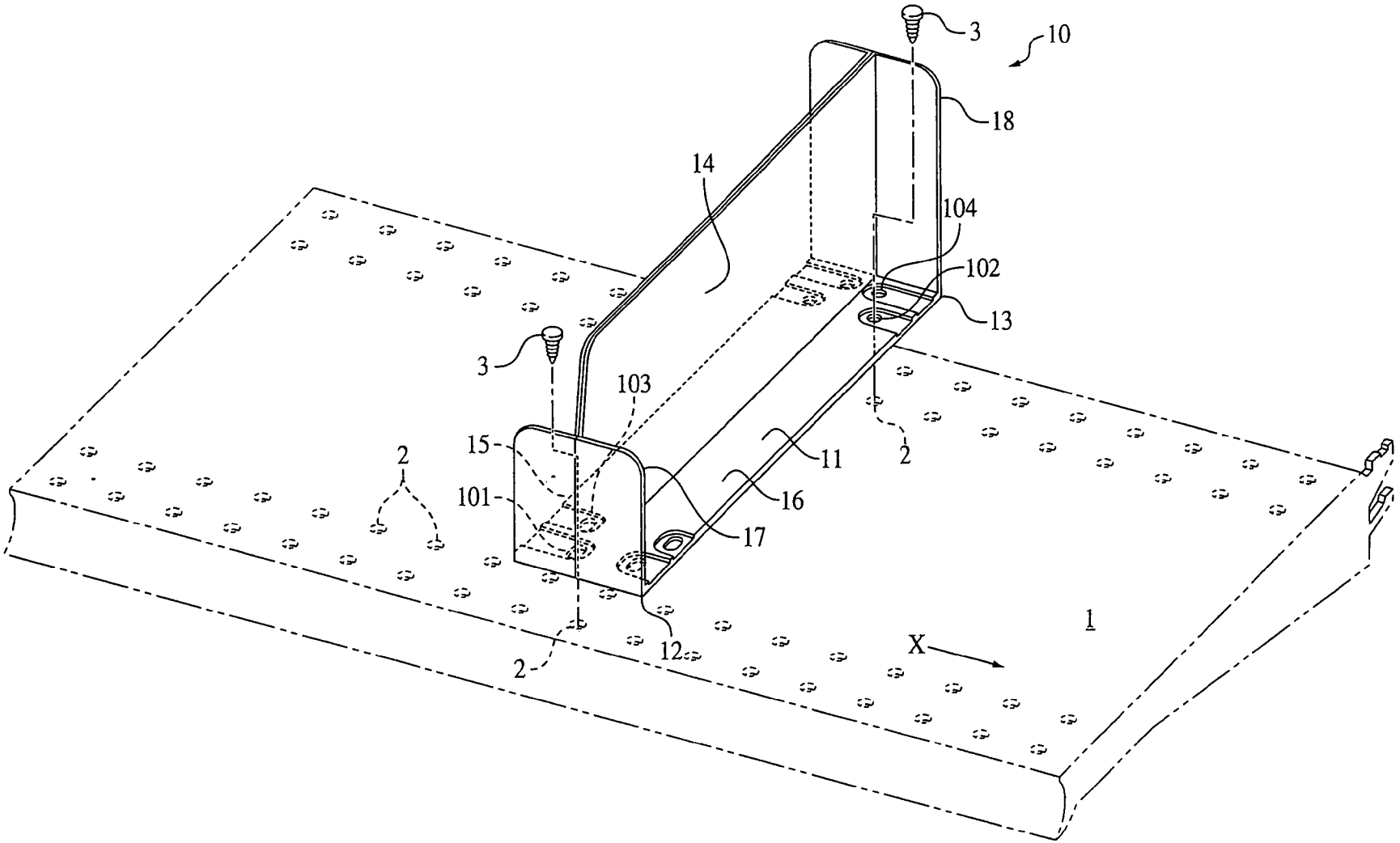
FIG. 1 shows a front perspective view of a product display partition according to an embodiment of the invention.

Referring now in detail to the drawings and, in particular, FIG. 1 shows a front perspective view of a product display partition 10 for selectively securing to a shelf 1. As shown, product display partition 10 may serve as a center divider for dividing two adjacent rows of products displayed on shelf 1. Shelf 1 has a plurality of connection points 2 which are spaced apart from one another by a fixed distance. Connection points 2 may comprise, for example, a series of through holes or recesses for securing various fixtures to the shelf. Connection points 2 may be arranged, for example in a regular repeating pattern so that various fixtures may be secured at various positions along the shelf by selecting the appropriate connection points. For example, connection points 2 may be arranged so that adjacent connection points are spaced approximately one inch on center.

Product display partition 10 may be formed from a rigid, lightweight material, for example a plastic material. Additionally, product display partition 10 may comprise a transparent or translucent material.

Product display partition 10 has a base portion 11 having a first end 12 and a second end 13. A dividing wall spans between first end 12 and second end 13 of base portion 11 and extends upwardly from base portion 11. Dividing wall 14 divides base portion 11 into a first side 15 and a second side 16. In use, dividing wall 14 may separate rows of similar or dissimilar displayed products disposed on shelf 1.

Product display partition 10 further comprises a plurality of openings 101, 102, 103, 104 for securing product display partition 10 to shelf 1. This plurality of openings includes a first pair of openings 101, 102. First pair of openings 101, 102 includes a first opening 101 disposed at the first end 12 and first side 15 of base portion 11 and a second opening 102 disposed at the second end 13 and second side 16 of base portion 11.

The plurality of openings also includes a second pair of openings 103, 104. Second pair of openings 103, 104 include a third opening 103 disposed at the first end 12 and first side 15 of base portion 11 and a fourth opening 104 disposed at the second end 13 and second side 16 of base portion 11.

First and second openings 101, 101 are arranged such that a center of first opening 101 is spaced at a distance from a center of second opening 102 equal to the distance between connection points 2 on shelf 1 in a direction x substantially perpendicular to dividing wall 14. For example first opening 101 and second opening 102 may be spaced at a distance of approximately one inch on center. Likewise, third opening 103 is spaced so that its center is spaced at a distance from a center of fourth opening 104 equal to the distance between connection points 2 on shelf 1 in a direction x substantially perpendicular to dividing wall 14. For example, third opening 103 and fourth opening 104 may be spaced at a distance of approximately one inch on center.

First opening 101 and third opening 103 are arranged such that the center of first opening 101 is spaced at a distance from the center of third opening 103 less than the distance between connection points 2 on shelf 1 in a direction x substantially perpendicular to dividing wall 14. For example, first opening 101 and third opening 103 may be spaced apart a distance of approximately ¼ inch on center. A similar relationship exists between second opening 102 and fourth opening 104.

In this way, product display partition 10 may be secured to shelf connection points 2 at various intervals along direction x. Such intervals correspond to the spacing or distance between first 101 and third 103 openings and second 102 and fourth 104 openings. The product display partition 10 may be secured by aligning first opening 101 and second opening 102 with desired connection points 2 on shelf 1 or by aligning third opening 103 and fourth opening 104 with the connection points 2.

The arrangement and spacing of openings 101, 102, 103, 104 allows product display partition 10 to be positioned on shelf 1 with a high degree of adjustability. This increased adjustability permits partitions to be positioned so as to conform closely to a required width for a particular product to be located adjacent the partition. In addition, the increased adjustability resulting from the arrangement and spacing of openings 101, 102, 103 and 104 allows for more efficient use of shelf space, a substantial benefit in a retail environment where shelf space may be limited.

Product display partition 10 may be secured to shelf 1 via plugs 3 which are inserted though the openings in the base portion 11 of the partition 10. Plugs 3 may engage respective connection points 2 on the shelf 1. Such plugs 3 are preferably removable so the product display partition 10 may be removed and/or re-positioned as needed.

As shown in FIG. 1, first opening 101 and third opening 103 may be disposed at different distances from first end 12 of base portion 11. Similarly, second opening 102 and fourth opening 104 may be disposed at different distances from second end 13 of base portion 11. This staggered arrangement of openings allows for the openings to be positioned on center at a smaller distance than the width of the openings. This feature further adds to the high degree of adjustability of product display partition 10.

Product display partition 10 may further comprise a first wall 17 disposed at the first end 12 of base portion 11 and a second wall 18 disposed at the second end 13 of base portion 11. First wall 17 and second wall 18 extend upwardly from base portion 11. First wall 17 may have a height which is smaller than a height of second wall 18. Product display partition 10 may then be selectively secured to shelf 1 with either first wall 17 or second wall 18 adjacent to a front portion of shelf 1 in order to accommodate products of various heights. For example if shorter products are to be displayed, product display partition 10 may be secured to shelf 1 with shorter first wall 17 adjacent to a front of shelf 1. However, if taller products are to be displayed, product display partition 10 may be reversed, so that taller second wall 18 is adjacent to the front of shelf 1. In this way, a single product display partition or center divider may be used for a multitude of products of various dimensions.

Figure 2:
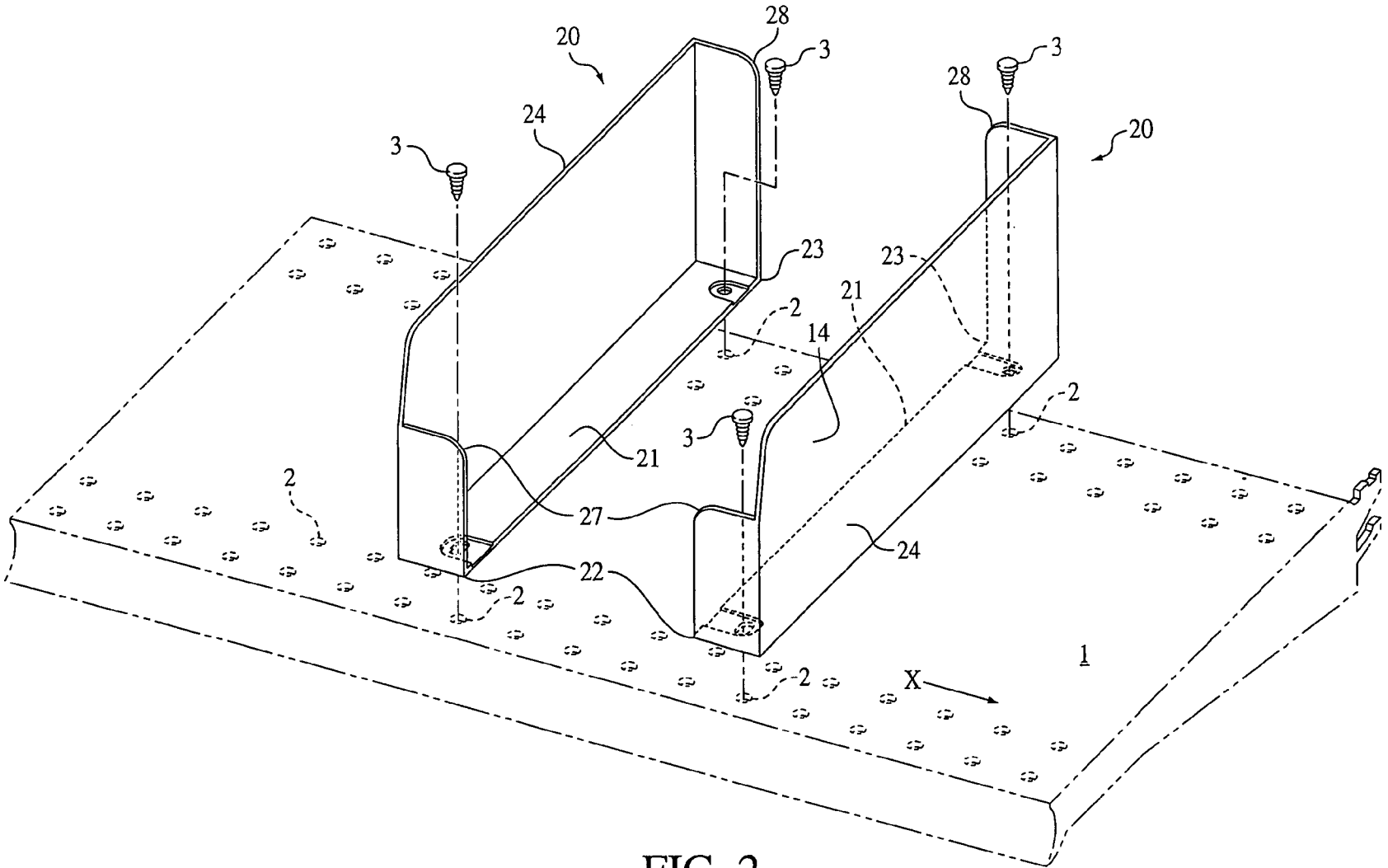
FIG. 2 shows a front perspective view of a reversible product display partition according to another embodiment of the invention.

FIG. 2 shows a reversible product display partition 20 according to another embodiment of the invention. As shown, reversible product display partition may serve as a left side divider or a right side divider. Reversible product display partition 20 has a base portion 21 with a first end 22 and a second end 23. One or more openings 201, 202 are disposed at each of the first 22 and second 23 ends of base portion 21 for securing base portion 21 to shelf connection points 2.

Reversible product display partition 20 includes a first wall 27 disposed at the first end 22 of base portion 21 and a second wall 28 disposed at the second end 23 of base portion 21. First wall 27 and second wall 28 extend upwardly from base portion 21. A dividing wall 24 extends upwardly from base portion 21 and spans between first wall 27 and second wall 28.

First wall 27 may have a height which is smaller than a height of second wall 28. Reversible product display partition 20 may then be selectively secured to shelf 1 with either first wall 17 or second wall 18 adjacent to a front portion of shelf 1 in order to accommodate products of various heights. For example, if shorter products are to be displayed, reversible product display partition 20 may be secured to shelf 1 with shorter first wall 27 adjacent to a front of shelf 1. However, if taller products are to be displayed, reversible product display partition 20 may be reversed, so that taller second wall 28 is adjacent to the front of shelf 1. In this way, a single product display partition may be used for a multitude of products of various dimensions.

As shown in FIG. 2, reversible product display partition 20 may be constructed with dividing wall 24 positioned either to the left of shorter first wall 27 or to the right of shorter first wall 27. Accordingly, reversible product display partitions 20 may be in the form of a left side divider, adapted for positioning at a left hand side of a row of products, or a right side divider, suitable for positioning at a right hand side of a row of products. As previously described, both the left side and right side dividers may be reversed to accommodate a height of the product to be displayed.

As with product display partition 10, reversible product display partition 20 may be secured to shelf 1 via plugs 3 which are inserted though the openings in base portion 21 as shown. Plugs 3 may engage respective connection points 2 on the shelf 1. Such plugs 3 are preferably removable so that reversible product display partition 20 may be removed and/or re-positioned as needed.

Figure 3:
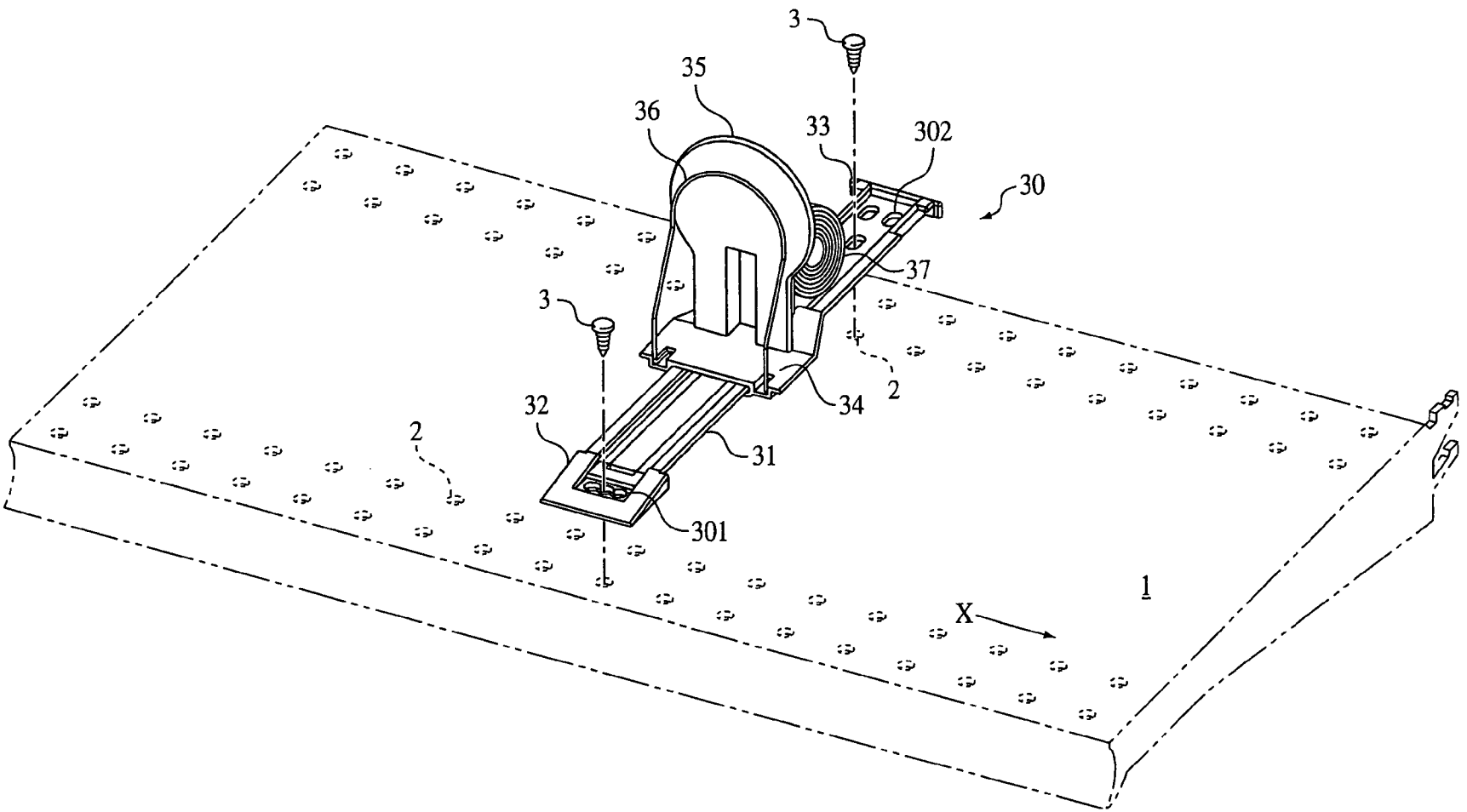
FIG. 3 shows a front perspective view of a device for biasing a row of products according to an embodiment of the invention.
Figure 4:
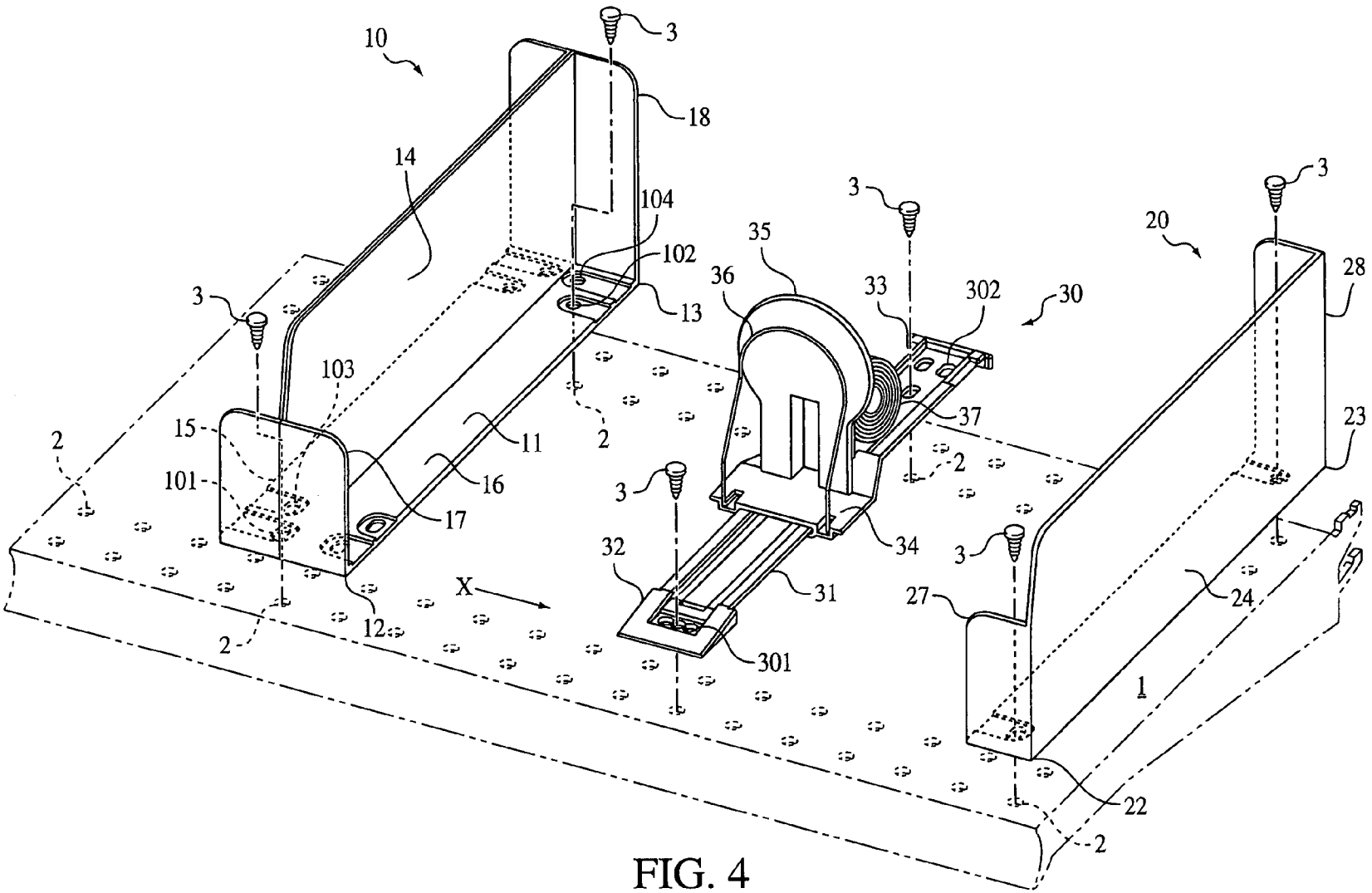
FIG. 4 shows a front perspective view of an assembly according to an embodiment of the invention.

FIG. 3 shows an embodiment of a device 30 for biasing a row of products toward a front portion of a shelf on which the products are disposed. As illustrated in FIG. 4, biasing device 30 may be incorporated into an assembly including one or more of product display partition 10 and/or reversible product display partition 20.

Biasing device 30 has a base portion 31 or track with a first end 32 adjacent to a front portion of shelf 1 and a second end 33 adjacent to a rear portion of shelf 1. At least one opening 301 is disposed at first end 32 and at least one opening 302 is disposed at second end 33 of base portion or track 31 for securing base portion or track 31 to shelf 1.

A product advancing member or pusher 34 is slidably mounted to base portion or track 31. Product advancing member 34 may comprise, for example a rigid, lightweight member which engages base portion or track 31 along a length of base portion or track 31. For example, product advancing member or pusher 34 may have one or more projections disposed at an underside of product advancing member 34, wherein the projection includes a channel to slidably engage a corresponding elements of base portion or track 31.

Product advancing member 34 has a face 35. Face 35 may extend upwardly from base portion 31 at an orientation substantially perpendicular to base portion or track 31. A support 36 is secured to product advancing member 34 and positioned in front of face 35 for holding at least one product against face 35. Support 36 may comprise, for example, a pusher spring wire comprising a rigid wire element which is formed as a loop.

Face 35 and support 36 are configured so that one or more of the products to be displayed on the shelf may be secured therebetween. A product to be displayed and held against face 35 by support 36 may comprise, for example, paper or plastic goods, such as for example, a package of paper or plastic plates, or any other item suitable for stocking on a shelf to which biasing device 30 may be secured. The product to be held against face 35 by support 36 typically is larger than face 35 and/or support 36.

Biasing device 30 further includes a biasing element 37 for biasing product advancing member 34 toward first end 32 of base portion 31. Biasing element 37 may comprise a spring element which is secured at one end to first end 32 of base portion 31. In one embodiment, biasing element 37 may comprise a length of flat metal spring material which is secured at one end to a first end 32 of base portion 31 and forms a coil which is uncoiled as product advancing member 34 is moved toward second end 33 of base portion 31.

In use, the one or more products held against face 35 by support 36 push against a product in front of product advancing member 34 and not held against face 35. This biases the row of products situated in front of product advancing member 34 toward the front portion of shelf 1. Accordingly, when a person removes a product from shelf 1, a biasing device according to an embodiment of the invention automatically advances the remaining products to the front of the 1. This provides a neat appearance of the products displayed on the shelf and thereby eliminates the need for manual leveling by shifting products by hand to a front of the shelf as products are removed.

As shown in FIG. 3, the at least one opening 301 at first end 32 of base portion 31 may comprise a plurality of openings, wherein a center of each opening is spaced from a center of an adjacent opening at a distance less than the distance between connection points 2 on shelf 1 in direction x. The at least one opening 302 at second end 33 of base portion 31 may also comprise a plurality of openings spaced on center at a distance less than a distance between connection points 2 in a direction x. Each of the openings 301, 302 may be dimensioned to receive a plug 3 as shown for selectively securing the biasing device 30 to shelf 1 at a desired position along shelf 3.

In one embodiment, the at least one opening 301 at first end 32 of base portion 31 comprises a plurality of interconnected openings, as illustrated in FIG. 3. At least one opening 302 at second end 33 of base portion 31 may include a plurality of openings arranged in a staggered pattern, as shown in FIG. 3, wherein adjacent openings are spaced at differing distances from second end 33 of base portion 31.

The arrangement and spacing of openings 301, 302 allows biasing device 30 to be positioned on shelf 1 with a high degree of adjustability, as previously described for product display partition 10. The increased adjustability resulting from the arrangement and spacing of openings 301, and 302 allows for more efficient use of shelf space, a substantial benefit in a retail environment where shelf space may be limited.

FIG. 4 shows an assembly according to an embodiment of the invention. As shown, a first product display partition or center divider 10 may be secured to shelf 1 at a desired location. A biasing device 30 may be secured adjacent first product display partition/center divider 10 at a desired location. The spacing of the openings provided in product display partition 10 and biasing device 30 allow these elements to be secured to shelf 1 in small increments of distance in direction x. Accordingly, the assembly can be arranged to accommodate a wide variety of product dimensions with a high degree of adjustability. In addition, a reversible product display partition in the form of a left or right side divider 20 may be arranged adjacent a center divider 10 and/or a biasing device 30 as shown. Both partitions/dividers 10 and 20 may be reversed as appropriate depending on the height of the products.

It is to be understood that the arrangement illustrated in FIG. 4 is exemplary only, and various other arrangements are contemplated, depending on the nature and sequence of products to be displayed on a particular shelf. For example, biasing device 30 may be omitted in some arrangements. Additionally, an assembly may include multiple product display partitions 10 and reversible product display assemblies 20 may be positioned at a left or right end portion of a shelf.

Accordingly, while several embodiments of the present invention have been shown and described, it is obvious that many changes and modifications may be made thereunto without departing from the spirit and scope of the invention.

What is claimed is:

1. A product display partition for selectively securing to a shelf having a plurality of connection points spaced apart by a fixed distance, said product display partition comprising:

a) a base portion having a first end and a second end;

b) a dividing wall extending upwardly from said base portion and spanning between said first end and said second end, thereby dividing said base portion into a first side and a second side; and c) a plurality of openings for securing the product display partition to the shelf, said plurality of openings comprising:

i) a first pair of openings comprising a first opening disposed at said first end and said first side of said base portion and a second opening disposed at said second end and said second side of said base portion; and ii) a second pair of openings comprising a third opening disposed at said first end and said first side of said base portion and a fourth opening disposed at said second end and said second side of said base portion;

wherein a center of said first opening and a center of said second opening are spaced apart from each other in a direction substantially perpendicular to said dividing wall by a first distance equal to the fixed distance between the connection points on the shelf;

wherein a center of said third opening and a center of said fourth opening are spaced apart from each other in said direction substantially perpendicular to said dividing wall by the first distance equal to the fixed distance between the connection points on the shelf;

wherein said center of said first opening and said center of said third opening are spaced apart from each other in said direction substantially perpendicular to said dividing wall by a second distance less than the fixed distance between the connection points on the shelf; and wherein the product display partition is securable to the shelf connection points at intervals equal to said second distance by aligning said first opening and said second opening or said third opening and said fourth opening with the shelf connection points.

2. The product display partition according to claim 1, wherein said first opening and said third opening are each disposed at a different distance from said first end of said base portion.

3. The product display partition according to claim 1, wherein the product display partition is secured to the shelf connection points with plugs which are insertable into said first opening and said second opening.

4. The product display partition according to claim 1, further comprising:

a) a first wall extending upwardly from said first end of said base portion and having a first height; and b) a second wall extending upwardly from said second end of said base portion and having a second height;

wherein said first height is smaller than said second height and the product display partition is selectively securable to the shelf with either said first wall or said second wall adjacent to a front of the shelf in order to accommodate products of various heights.

5. A device for biasing a row of products toward a front portion of a shelf on which the products are disposed, the shelf having a plurality of connection points spaced apart by a fixed distance, the device comprising:

a) a base portion comprising a first end adjacent to the front portion of the shelf and a second end adjacent to a rear portion of the shelf and having at least one opening disposed at said first end and at least one opening disposed at said second end for securing said base portion to the shelf;

b) a product advancing member slidably mounted to said base portion, said product advancing member comprising a face extending substantially perpendicular to said base portion and a support for holding at least one product against said face; and c) a biasing element for biasing said product advancing member toward said first end of said base portion;

wherein the at least one product held against said face pushes against a product not held against said face and disposed immediately in front of the at least one product held against said face, thereby biasing the row of products toward the front portion of a the shelf.

6. The device according to claim 5, wherein said biasing element comprises a spring having one end secured to said first end of said biasing base portion.

7. The device according to claim 6, wherein said spring comprises a coiled length of flat metal.

8. The device according to claim 5, wherein said support comprises a rigid wire element formed as a loop.

9. The device according to claim 5, wherein said at least one opening disposed at said first end comprises a first opening and a second opening, wherein a center of said first opening and a center of said second opening are spaced apart in a direction substantially perpendicular to said base portion by a distance less than the distance between the connection points on the shelf.

10. The device according to claim 5, wherein said at least one opening disposed at said second end comprises a first opening and a second opening, wherein a center of said first opening and a center of said second opening are spaced apart in a direction substantially perpendicular to said base portion by a distance less than the distance between the connection points on the shelf.

11. The device according to claim 5, wherein said at least one opening disposed at said first end comprises a plurality of interconnected openings, wherein each of said plurality of interconnected openings is adapted to receive a plug for securing the device to the shelf connection points.

12. An assembly for securing to a shelf having a plurality of products disposed thereon and having a plurality of connection points spaced apart by a fixed distance, the assembly comprising:

a) a first product display partition comprising:

ii) a base portion having a first end and a second end;

ii) a dividing wall extending upwardly from said base portion and spanning between said first end and said second end, thereby dividing said base portion into a first side and a second side; and iii) a plurality of openings for securing said first product display partition to the shelf, said plurality of openings comprising:

a first pair of openings comprising a first opening disposed at said first end and said first side of said base portion and a second opening disposed at said second end and said second side of said base portion; and a second pair of openings comprising a third opening disposed at said first end and said first side of said base portion and a fourth opening disposed at said second end and said second side of said base portion;

wherein a center of said first opening and a center of said second opening are spaced apart from each other in a direction substantially perpendicular to said dividing wall by a first distance equal to the fixed distance between the connection points on the shelf;

wherein a center of said third opening and a center of said fourth opening are spaced apart from each other in said direction substantially perpendicular to said dividing wall by the first distance equal to the fixed distance between the connection points on the shelf;

wherein said center of said first opening and said center of said third opening are spaced apart from each other in said direction substantially perpendicular to said dividing wall by a second distance less than the fixed distance between the connection points on the shelf; and b) a biasing device disposed adjacent to said first product display partition for biasing a row of products toward a front portion of the shelf, the biasing device comprising:

i) a base portion comprising a first end adjacent to a front portion of the shelf and a second end adjacent to a rear portion of the shelf and having at least one opening disposed at said first end and at least one opening disposed at said second end for securing said base portion to the shelf;

ii) a product advancing member slidably mounted to said base portion, said product advancing member comprising a face extending substantially perpendicular to said base portion and a support for holding at least one product against said face; and iii) a biasing element for biasing said product advancing member toward said first end of said base portion;

wherein said first product display partition is securable to the shelf connection points at intervals equal to said second distance by aligning said first opening and said second opening or said third opening and said fourth opening with the shelf connection points; and wherein the at least one product held against said face pushes against a product not held against said face and disposed immediately in front of the at least one product held against said face, thereby biasing the row of products toward the front portion of the shelf.

13. The assembly according to claim 12, further comprising a second product display partition disposed adjacent to said biasing device and on an opposite side of said biasing device as said first product display partition, said second product display partition comprising:

a) a base portion comprising a first end and a second end and having at least one opening disposed at said first end and at least one opening disposed at said second end for securing said second product display partition to the shelf connection points;

b) a first wall extending upwardly from said first end of said base portion and having a first height;

c) a second wall extending upwardly from said second end of said base portion and having a second height; and d) a dividing wall extending upwardly from said base portion and spanning between said first wall and said second wall;

wherein said first height is smaller than said second height and said second product display partition is selectively securable to the shelf with either said first wall or said second wall adjacent to the front of the shelf in order to accommodate products of various heights.

14. The assembly according to claim 12, wherein said first product display partition further comprises:

a) a first wall extending upwardly from said first end of said base portion and having a first height; and b) a second wall extending upwardly from said second end of said base portion and having a second height;

wherein said first height is smaller than said second height and said first product display partition is selectively securable to the shelf with either said first wall or said second wall adjacent to the front of the shelf in order to accommodate products of various heights.

* * * * *

UNITED STATES PATENT AND TRADEMARK OFFICE

CERTIFICATE OF CORRECTION

PATENT NO. : 7,478,731 B1
APPLICATION NO. : 11/329021
DATED : January 20, 2009
INVENTOR(S) : Mason It is certified that error appears in the above-identified patent and that said Letters Patent is hereby corrected as shown below:

In particular, in Column 9, line 8, (Line 3 of Claim 6) after "said", please delete: "biasing".

Signed and Sealed this

Tenth Day of March, 2009

John Doll

JOHN DOLL
*Acting Director of the United States Patent and Trademark Office*